US005857224A

United States Patent [19]

Oberg et al.

[11] Patent Number: 5,857,224

[45] Date of Patent: Jan. 12, 1999

[54] PRESSURE FLUSH TANK FOR USE IN A TOILET ENCLOSURE

[75] Inventors: Erik J. Oberg, Ypsilanti; Ming Ge, Farmington Hills, both of Mich.; Danny G. Orlowski, Jr., Holland, Ohio

[73] Assignee: Sloan Valve Company, Franklin Park, Ill.

[21] Appl. No.: 949,514

[22] Filed: Oct. 14, 1997

[51] Int. Cl.[6] ..... E03D 3/04

[52] U.S. Cl. ..... 4/354; 4/363; 4/332; 220/4.12; 220/592

[58] Field of Search ..... 4/300, 343, 353, 4/354, 363, 364, 368, 369, 370, 378, 416, 417, 418, 419, 332, 355, 356, 357, 358, 359, 360, 361, 362, 415; 220/4.21, 592, 4.12, 4.13, 4.26, 651, 653, DIG. 12

[56] References Cited

U.S. PATENT DOCUMENTS 2,488,232 11/1949 Peeler ..... 4/354
3,467,967 9/1969 Steinmann ..... 4/354
4,233,698 11/1980 Martin ..... 4/354
5,553,333 9/1996 Andersson ..... 4/354

*Primary Examiner*—Henry J. Recla
*Assistant Examiner*—Kerry S. Culpepper
*Attorney, Agent, or Firm*—Dorn, McEachran, Jambor & Keating

[57] ABSTRACT

A pressure flush tank for toilets is formed and adapted to be located within a toilet enclosure and is preferably formed of a non-metallic material such as plastic. The pressure flush tank has an essentially rectangular vertical cross section and an essentially rectangular horizontal cross section, with the tank including an upper housing portion and a lower housing portion. There is a peripheral projection on the lower surface of the upper housing portion and a peripheral recess along a facing surface of the lower housing portion, with the projection being positioned within and ultrasonically welded to the recess. Each of the housing portions has side walls and end walls, with each housing portion having reinforcing interior walls extending between opposing side walls to provide strength and rigidity for the pressure flush tank.

8 Claims, 2 Drawing Sheets

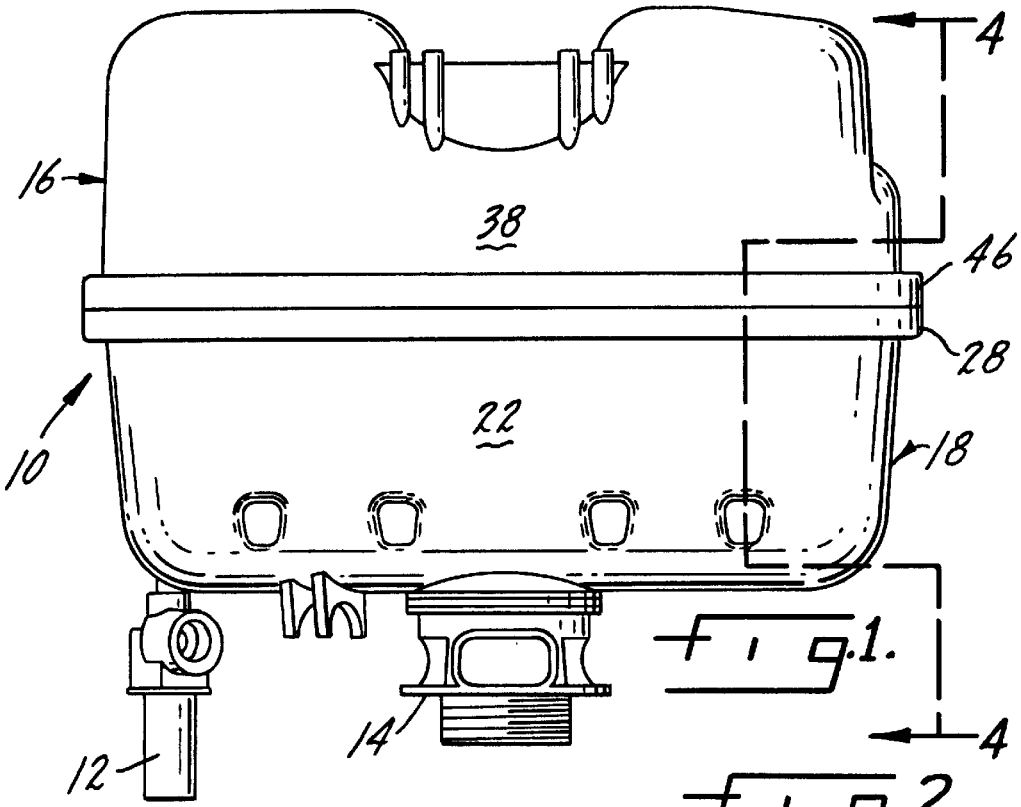
Fig. 1.
Fig. 2.
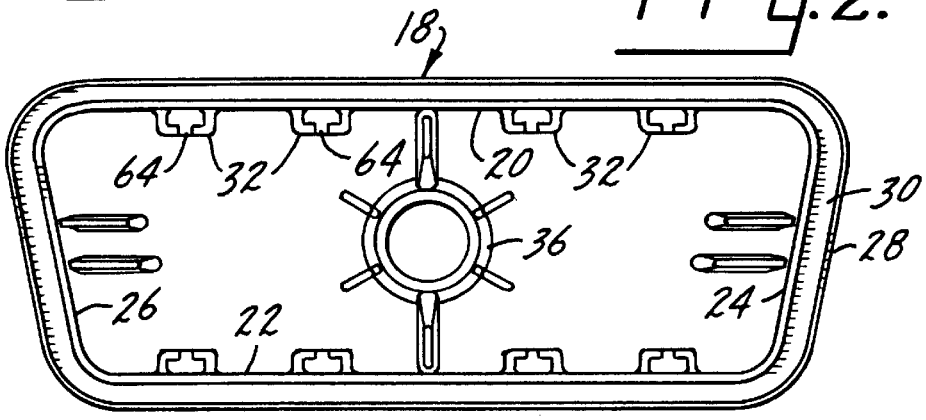
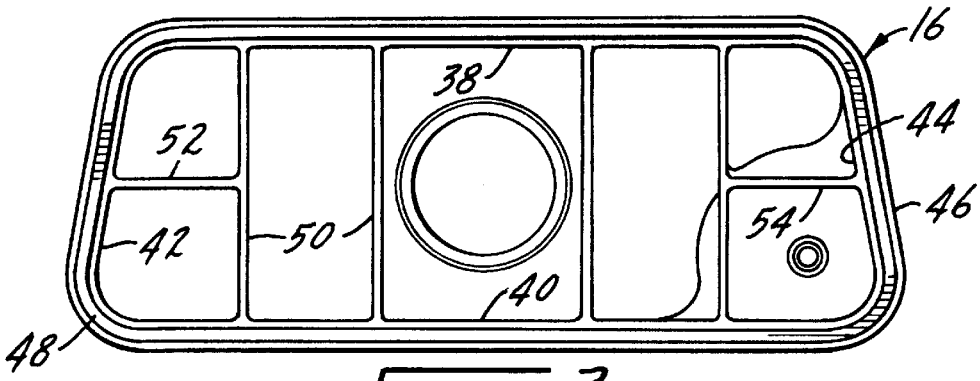
Fig. 3.

Fig. 4.
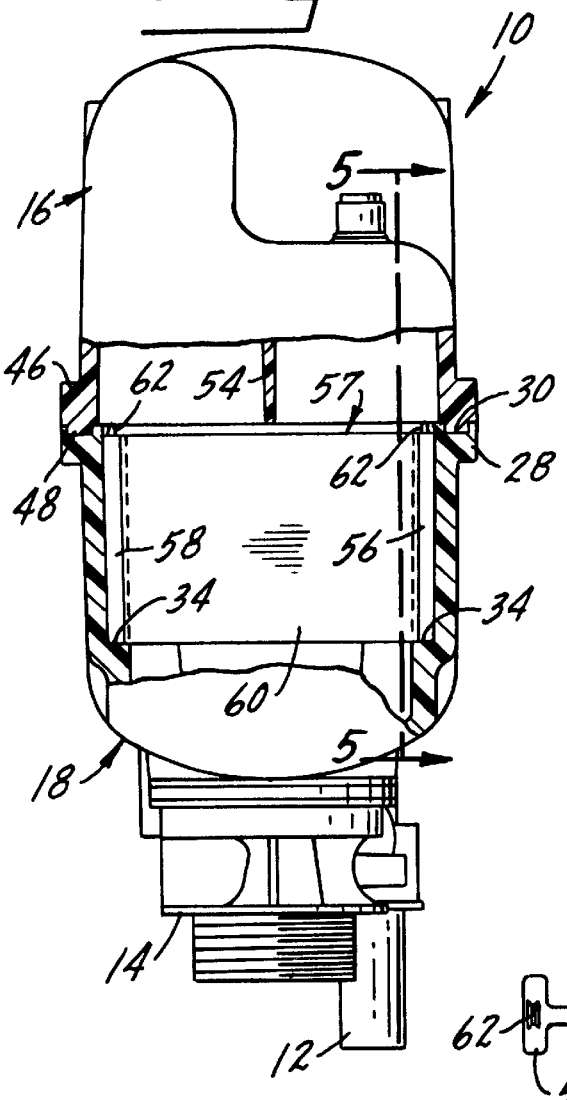
Fig. 5.
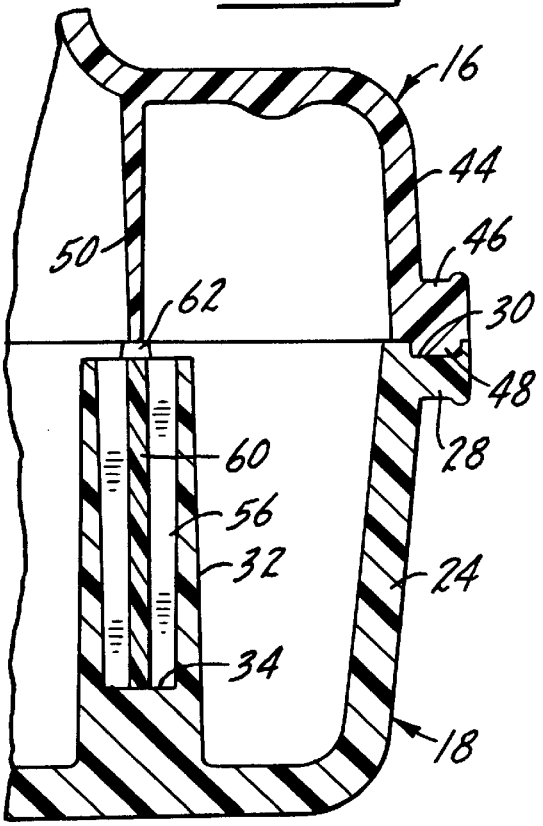
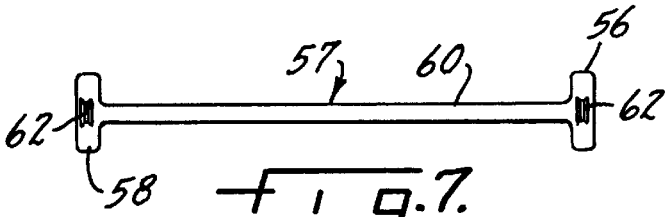
Fig. 7.
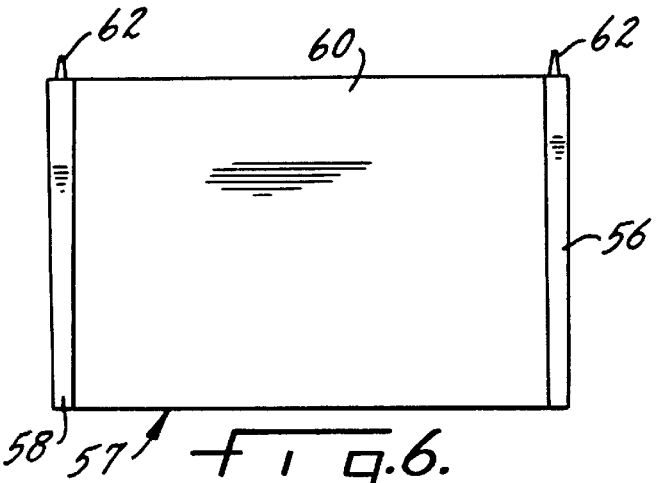
Fig. 6.
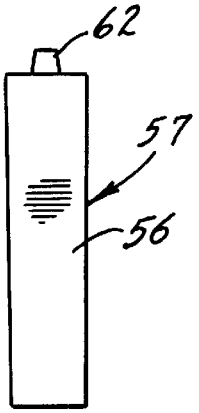
Fig. 8.

PRESSURE FLUSH TANK FOR USE IN A TOILET ENCLOSURE

THE FIELD OF THE INVENTION

The present invention relates to pressure flush tanks for toilets of the type disclosed in U.S. Pat. No. 4,233,698. In the past it has been necessary for such pressure flush tanks to be essentially cylindrical to provide the necessary strength and rigidity to contain water under the pressures utilized in such flushing systems. However, cylindrical flush tanks are not readily adaptable to the interior of the china tanks which are made by the major manufacturers of toilets. Heretofore, it has not been possible to utilize an essentially rectangular pressure flush tank which is far more convenient and acceptable for the interior of toilet tanks. The present invention provides a reinforced pressure flush tank which is essentially rectangular in both horizontal and vertical cross section and will readily fit within the interior of existing toilet flush tanks.

SUMMARY OF THE INVENTION

The present invention relates to pressure flush tanks and in particular to an improved pressure flush tank which is readily adaptable to the interior of existing china toilet tanks.

A primary purpose of the present invention is an essentially rectangular pressure flush tank for the use described.

Another purpose is a pressure flush tank as described which has reinforcing walls extending crosswise therein, which provides the rigidity and strength necessary to contain water under pressure for the use described.

Other purposes will appear in the ensuing specification, drawings and claims.

BRIEF DESCRIPTION OF THE DRAWINGS

The invention is illustrated diagrammatically in the following drawings wherein:

FIG. 1 is a side view of a pressure flush tank of the present invention;

FIG. 2 is a top view of the bottom housing section of the pressure flush tank;

FIG. 3 is a bottom view of the top housing section of the pressure flush tank;

FIG. 4 is a section along plane 4—4 of FIG. 1;

FIG. 5 is a section along plane 5—5 of FIG. 4;

FIG. 6 is a side view of a reinforcing wall;

FIG. 7 is a top view of a reinforcing wall; and

FIG. 8 is an end view of a reinforcing wall.

DESCRIPTION OF THE PREFERRED EMBODIMENT

The present invention relates to pressure flush tanks of the type shown in U.S. Pat. No. 4,233,698, the disclosure of which is incorporated by reference herein. Such a pressure flush tank includes a mechanism for admitting water and air to the interior of the tank, with the incoming water compressing the air to the water inlet pressure. The mechanism includes a valve which will discharge the water under pressure to a toilet bowl when operated and there are provisions for refilling the tank after discharge. Such a valve mechanism is not shown in the present application, but it will be understood by those skilled in the art that such will be present when the pressure flush tank is in its intended environment. The present invention is specifically directed to the tank, its configuration, and its construction.

The pressure flush tank is indicated generally at 10 in FIG. 1 and there may be an inlet connection 12 for water, which connection will be connected to the cold water supply in the environment of use. There is a discharge fixture 14 at the bottom of the pressure flush tank and conventionally, this will discharge water from the interior of the tank into the toilet bowl. As described above, when water is admitted into the tank for filling it, air is also drawn in, as described in the '698 patent, with the result that the water will be under pressure, and that pressure will be essentially equal to the line pressure of the supply feeding the tank.

The pressure flush tank 10 includes an upper housing section 16 and a lower housing section 18. As shown particularly in FIGS. 2 and 3, both the upper and lower housing sections have an essentially rectangular horizontal cross section. Although the ends are not strictly perpendicular to the side walls, nevertheless, it may be considered that the tank has an essentially rectangular cross section. When viewing the end of the toilet tank as shown in FIG. 4, again it is clear that the tank has an essentially rectangular vertical cross section. The top and bottom may be slightly rounded, but nevertheless, the overall cross section is essentially rectangular.

The bottom section 18, illustrated in FIG. 2, has side walls 20 and 22 which are connected by end walls 24 and 26. As shown specifically in FIG. 4, the upper surface of the bottom section 18 has a peripheral flange 28 which has a peripheral recess 30. Each of the side walls 20 and 22 of the lower housing section 18 has a plurality of brackets 32 which, as shown in FIG. 2, are aligned with a bracket on the opposing side wall. The brackets extend a substantial portion of the height of the side walls 20 and 22 and each terminates at a bottom ledge 34, as shown in FIG. 4.

The lower housing section 18 is completed by a support structure indicated generally at 36, which is centrally located in the bottom section and will support the valve mechanism referenced above and shown in the '698 patent or a valve mechanism which will perform the same function as that in the '698 patent.

The upper housing section is shown from the bottom in FIG. 3 and comprises side walls 38 and 40 and end walls 42 and 44. As clearly indicated in FIGS. 2 and 3, the upper and lower housing sections have mating and mirror image cross sections. The upper housing section 16 has a peripheral flange 46, which has a downwardly-extending peripheral projection 48 which is received within the recess 30 in the lower housing section. During assembly there will be an ultrasonic weld of the tank sections at this joint. The upper housing section 16 has a plurality of reinforcing walls indicated at 50 which extend crosswise between the side walls 38 and 40. There are further short reinforcing walls 52 and 54 extending between the end walls 42 and 44 and the next adjacent reinforcing walls 50. The reinforcing walls provide rigidity to the upper housing section and permit a rectangular cross section for this structure.

The lower housing section uses separate reinforcing walls, whereas, those in the upper housing section are formed integral during the molding process. In this connection, it is preferred that a suitable plastic be used for the material of the pressure flush tank. FIGS. 6, 7 and 8 show the reinforcing walls 57 for the lower section. They are in the shape of an I-beam having end flanges 56 and 58 connected by a central web 60. Each of the end flanges 58 and 60 has an upwardly-extending projection 62 at the upper end thereof, as particularly shown in FIGS. 6 and 8. The flanges 56 and 58 will be inserted within the aligned brackets 32 in the lower housing section during assembly. They may be ultrasonically welded in place or they may be positioned as shown in FIG. 4. without a permanent connection to the housing structure.

The separate reinforcing walls 57 for the lower housing section 18 will each bottom on a ledge 34 and the flanges 58 and 56 will extend within the brackets 32. The webs 60 will pass through the slots 64 in each of the brackets 32. The upward projections 62 will contact the lower surface of the reinforcing walls 50 illustrated in FIG. 3 and as particularly shown in FIGS. 4 and 5. There will be an ultrasonic weld between these projections and the bottom surface of the reinforcing walls 50, thus providing further rigidity and strength to the tank structure. The reinforcing walls 50 and 57 are in vertical alignment when the tank is assembled.

As clearly shown in FIG. 4, even though the reinforcing walls 57 of the lower section extend from one side to another, they stop short of the bottom of the tank, thus providing communication between all portions of the tank interior. It is not subdivided into compartments, rather, the reinforcing walls are only there for providing rigidity to the generally horizontal and vertical rectangular cross section configuration of the tank.

Whereas the preferred form of the invention has been shown and described herein, it should be realized that there may be many modifications, substitutions and alterations thereto.

The embodiments of the invention in which an exclusive property or privilege is claimed are defined as follows:

1. A pressure flush tank for toilets, which tank is for location within a toilet enclosure, said pressure flush tank being formed of a non-metallic material and having an essentially rectangular vertical cross section and an essentially rectangular horizontal cross section, said tank including an upper housing portion and a lower housing portion, one of said upper and lower housing portions having a peripheral projection along a surface facing the other housing portion and the other housing portion having a peripheral recess within which said peripheral projection is located, each of said housing portions having side walls and end walls, each of said housing portions having reinforcing interior walls extending between opposing side walls to provide strength and rigidity for said tank.

2. The pressure flush tank of claim 1 wherein said peripheral projection and said peripheral recess are joined by ultrasonic welding.

3. The pressure flush tank of claim 1 wherein said peripheral projection is formed on said upper housing portion.

4. The pressure flush tank of claim 1 wherein one of said housing portions side walls has a plurality of facing and uniformly spaced vertically extending brackets, the reinforcing interior wall for said one housing portion having end portions thereof which extend within said brackets.

5. The pressure flush tank of claim 4 wherein said end portions of said reinforcing interior wall are in the form of flanges extending generally perpendicular to said reinforcing wall.

6. The pressure flush tank of claim 5 wherein said reinforcing wall flanges have projections extending toward the reinforcing walls on the other of said housing portions and in contact with said reinforcing walls of the other housing portion.

7. The pressure flush tank of claim 6 wherein said projections are ultrasonically welded to the reinforcing walls of said other housing portion.

8. The pressure flush tank of claim 1 wherein the reinforcing interior walls of each of said housing portions are in vertical alignment.

* * * * *